United States Patent [19]

Bertaud et al.

[11] Patent Number: 4,488,955

[45] Date of Patent: Dec. 18, 1984

[54] SUB-CATHODIC SHIELD WITH DEFORMABLE ZONES FOR HALL-HEROULT ELECTROLYSIS CELLS

[75] Inventors: Yves Bertaud; Michel Leroy, both of Saint Jean de Maurienne, France

[73] Assignee: Aluminium Pechiney, Paris, France

[21] Appl. No.: 610,118

[22] Filed: May 14, 1984

[30] Foreign Application Priority Data

May 16, 1983 [FR] France ..... 83 08333

[51] Int. Cl.[3] ..... C25C 3/08; C25C 7/00

[52] U.S. Cl. ..... 204/243 R; 204/279

[58] Field of Search ..... 204/67, 243 R, 244–247, 204/279

[56] References Cited

U.S. PATENT DOCUMENTS 2,861,036 11/1958 Simon-Suisse ..... 204/243 R
3,494,851 2/1970 Cauvin, Jr. ..... 204/243 R
4,175,022 11/1979 Vadla et al. ..... 204/243 R
4,322,282 3/1982 Jemec ..... 204/243 R
4,430,187 2/1984 Snaeland et al. ..... 204/243 R

*Primary Examiner*—Donald R. Valentine
*Attorney, Agent, or Firm*—Dennison, Meserole, Pollack & Scheiner

[57] ABSTRACT

A subcathodic shield for use with Hall-Heroult electrolysis cells. The shield, which is located below the carbonaceous blocks which make up the cathode, and above the cell housing, comprises at least one continuous steel sheet at least 5 mm thick extending substantially over the total area between the base of the cathode and the base of the housing, and which has at least one deformable zone for absorbing thermal stresses caused by differences in temperatures between the shield section situated below the central area of the cathode and the shield section situated below the peripheral areas of the cathode.

8 Claims, 5 Drawing Figures

SUB-CATHODIC SHIELD WITH DEFORMABLE ZONES FOR HALL-HEROULT ELECTROLYSIS CELLS

BACKGROUND OF THE INVENTION

The present invention relates to the construction of electrolysis cells for the production of aluminum by the Hall-Heroult process. More particularly, the present invention relates to a shield which is intended to prevent seepage of the electrolyte constituents into the subcathodic region.

Cells for the production of aluminum by the Hall-Heroult process generally consist of a metallic housing, the base of which is coated with a refractory and insulating material, this housing supporting the carbonaceous blocks which form the cathode on which the liquid aluminum is deposited. Sealed contact between adjacent cathodic blocks and between the cathodic blocks and the walls of the housing is generally assured by a carbonaceous paste or coating which is based on pitch and coke or anthracite.

After the initial heating of the cell, fissures such as in the paste may be formed by the action of differential expansion, through which fissures the molten electrolyte, consisting for the most part of cryolite, begins to seep. This cryolite seepage tends to erode the insulating properties of the underlying refractory material. Liquid aluminum may also seep through the same channels and attack the insulating refractories which are located between the carbonaceous cathode and the metallic housing. These refractories are generally composed of silica or silicates which are reducible by the liquid aluminum.

Moreover, particularly during the initial months of operation of the electrolysis cells, there is a gradual impregnation of the carbonaceous coating of the cell by the constituent elements of the bath and in particular by sodium and fluorine. When these sodium-containing and fluorine-containing materials have penetrated the carbonaceous coating they may attack the underlying insulating coating.

As a result of this erosion of the thermal insulators by these materials, the thermal insulation of the cell is reduced and thermal losses are increased. This is not only detrimental to the energy consumption per ton of aluminum which is produced, but it also means that it is difficult to find a satisfactory thermal balance for a series of cells which are of different ages.

In order to limit the effect of seepage and impregnation, it was proposed in U.S. Pat. No. 4,175,022 corresponding to French Pat. No. A-2,388,901, to place a protective steel layer below the insulating material. For a shield of this type to be effective, however, the patentee stipulated that it would have to be relatively thick, more than 5 mm, and would have to be continuous. Moreover, the periphery thereof would have to be maintained at a sufficiently low temperature (from 500°–600° C.) to prevent sodium-containing and fluorine-containing seepages (cryolite) from deforming it.

Under these conditions, a monoblock thick screen suffers from two major disadvantages:

the difference in temperature between the center (about 900° C.) and the periphery (about 500° C.) of the shield gives rise to a considerable thermal flow towards the periphery of the vat, thereby unacceptably modifying its thermal operations and degrading energy consumption; and this difference in temperature causes considerable differential thermal expansion between the center of the shield and its periphery and this gives rise to detrimental deformation of the coating and the cathode.

SUBJECT OF THE INVENTION

The present invention provides a metallic steel shield, which is placed under the base of the carbonaceous blocks forming the cathode of the electrolysis cell, and which extends at least over the whole area at the base of the cathode. This shield comprises at least one continuous sheet of steel, at least half of the surface of which is formed by a section which has a thickness of at least 5 mm and preferably from 8–12 mm, and which shield comprises at least one deformable zone which absorbs the stresses which are caused by the difference in temperature between the central part which is situated at the base of the cathode and the peripheral part.

The deformable zone may consist of at least one closed profile, the wall of which is not as thick as the thick sheet of steel, or of at least one open profile, the wall of which is of equal or lesser thickness than the thick sheet of steel, or of a sheet of steel which is not as thick as the thick shield, which is located at the periphery of the shield and extends into the zone which is situated just outside the base of the cathodic blocks and which is joined to the thick screen by a continuous weld.

The shield may also consist of two separate sections, a first thick section which is at least 5 mm thick and is provided with means for absorbing the stresses of expansion and a second section not joined to the first section which comprises of a series of thin plates superposed on each other, each of which plates is less than 5 mm thick, and which are located between the base of the cathode and the first thick section therebelow.

The shield may also include separate upper section which is formed by a steel bedplate which is connected to each cathodic bar by a weld and which is in electrical contact with at least 50% of the surface of the lower base of the corresponding carbonaceous block.

DESCRIPTION OF THE PREFERRED EMBODIMENT

Figure 1:
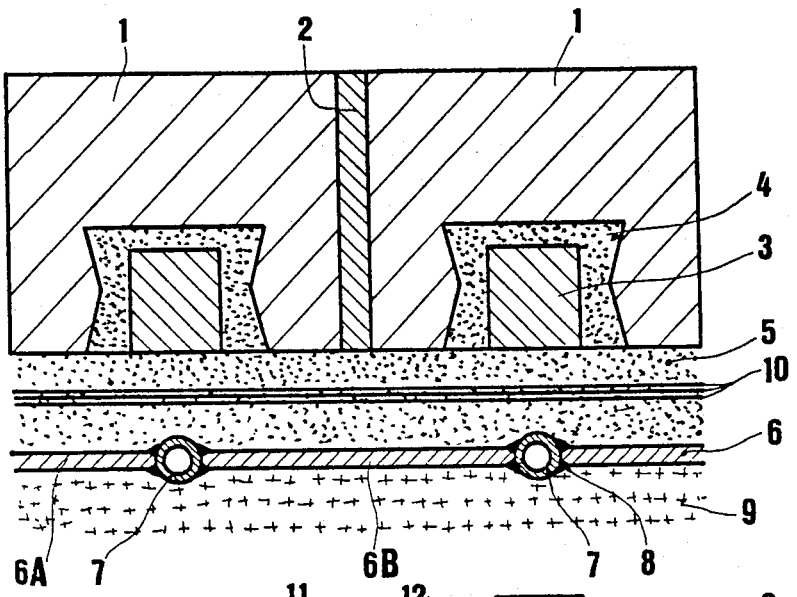
FIG. 1 shows a fragmentary cross-sectional view of a first embodiment of the present invention, wherein thermal stresses encountered by the shield are absorbed by the deformation of a tube.

The cathode of the electrolysis cell of FIG. 1 consists of carbonaceous blocks 1 which are connected by joints 2 of carbonaceous paste.

A steel cathodic bar 3 is embedded in the casting in a setting 4 at the base of carbonaceous block 1. Separated by a pulverulous supporting bed 5, is a shield 6 constituted by a steel sheet, the thickness of which is at least 5 mm, and preferably between 8 and 12 mm, consisting of a definite number of sections 6A and 6B which are joined by means of a closed hollow profile such as a steel tube 7 to which the sections 6A and 6B are joined such as by a tight, or fluid impervious continuous band 8. The walls of tube 7 are not as thick as shield 6 so that the tubes constitute a deformation zone which absorbs the expansion stresses of the shield. The tube wall may be, for example, half the thickness, 3 mm for a sheet of 6 mm. The shield is supported by coating 9 on the base of the housing.

It is possible to increase the efficiency of the shield 6 and prolong its life expectancy by placing one or more fairly thin (e.g. from 1 to 3 mm) steel sheets 10 between the base of cathodic blocks 1 and shield 6. These sheets act, for all intents and purposes, as a sacrifical barrier to the sodium-containing and fluorine-containing seepages which are produced in excess during the initial operational months of the electrolysis vat.

Figure 2A:
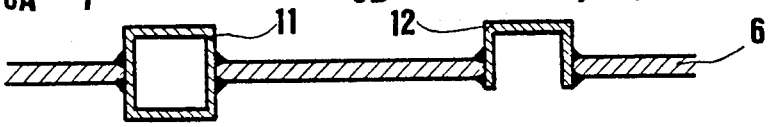
FIGS. 2A and 2B are fragmentary cross-sectional views of thermal shields showing variations in the structure of the embodiment of FIG. 1.
Figure 2B:
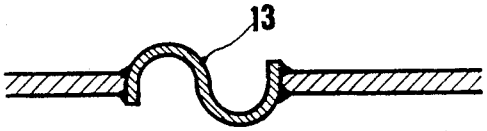

Further variations of the embodiment of FIG. 1 can be seen in FIGS. 2A and 2B. The element for absorbing the stresses of expansion may be a square tube 11, as shown in FIG. 2B, the thickness of the wall of which is half that of the shield, or an open profile such as a square semi-tube 12 which offers greater flexibility but may constitute a weak point due to the reduced thickness and the increased risk of more rapid penetration. The S-shaped stress absorbing member 13 of FIG. 2B is also very favorable from a point of view of flexibility, but it suffers from the same disadvantage.

Figure 3:
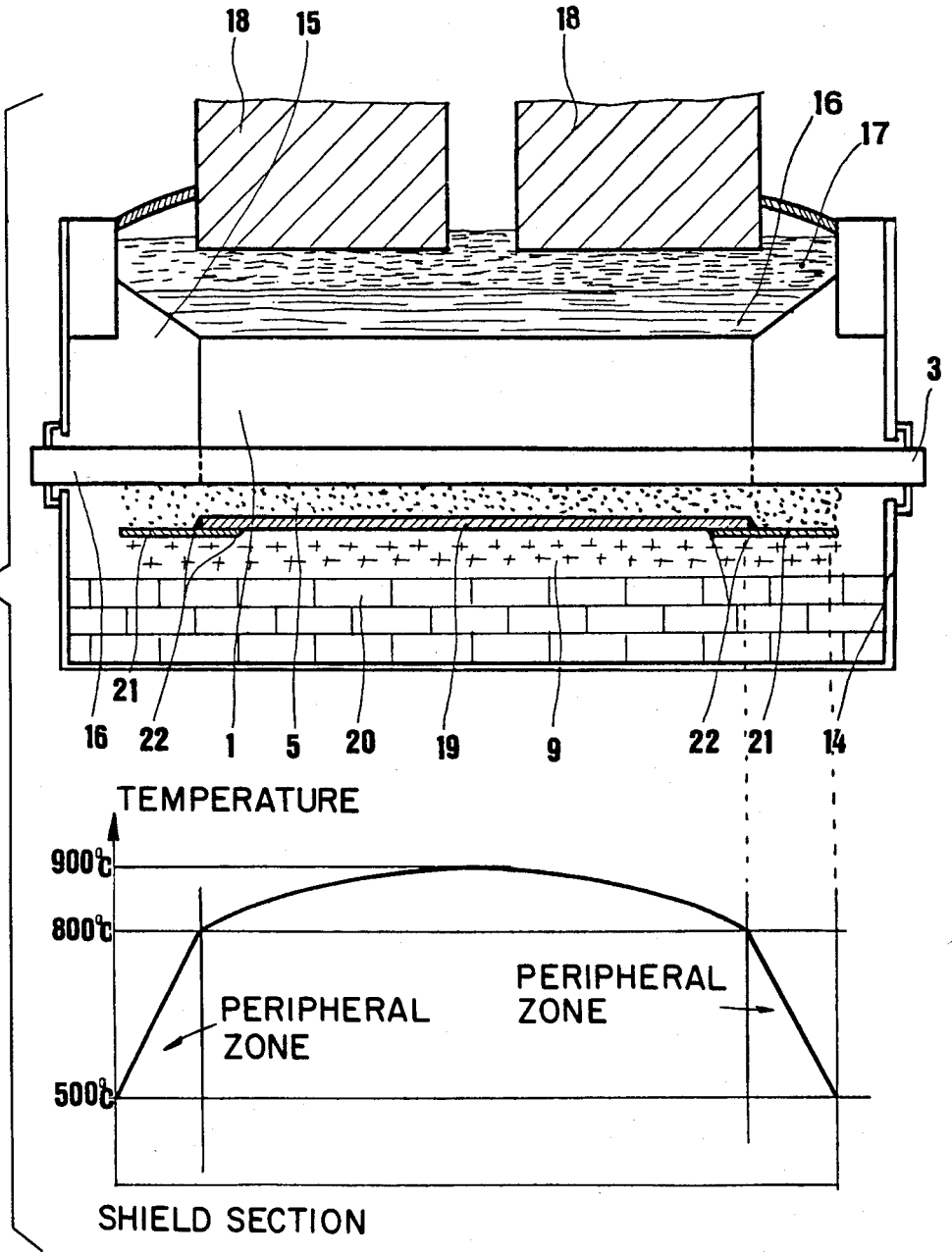
FIG. 3 is a schematic vertical cross-sectional view of a cell showing a further embodiment of a shield, in cross section, according to which the deformable zone consists of a thin sheet which is joined to the periphery of the shield consisting of a thick sheet and includes a graphic representation of thermal gradients in the cell.

FIG. 3 illustrates the second embodiment of the present invention. It shows, in schematic form, a cross section of an electrolysis cell, with metallic casing 14, lateral coating 15 of carbonaceous paste, cathodic blocks 1 in which the steel cathodic bars 3 are embedded, a layer of liquid aluminum 16, electrolyte 17, anodic system 18, supporting bed 9 of a shield 19 and heat-insulating bed 9 of shield 19 and heat-insulating brickwork 20 of the bottom of the housing.

The shield 19 is formed by a thick steel sheet, (at least 5 mm, and preferably from 8–12 mm) over the entire section where the thermal gradient is poor, that is to say in particular at the base of cathodic blocks 1. The temperature variations of the different sections of the shield are shown by the graph below the cell of FIG. 3.

In the peripheral zone of the shield where there is a considerable thermal gradient (from 800°–500° C.), the shield has been lengthened by a peripheral section comprising a thin sheet 21, for example from 2 to 5 mm, and which is thus less heat-conductive and more easily deformable, in particular in tension. The thin sheet is connected to the thick section by a tight continuous weld 22. This thin sheet preferably has an elongation limit at break of greater than 2% when cold (20° C.).

In every case, it is preferable that the thick section of the shield cover more than 50% of the total surface of the cathodic blocks. The thinner peripheral section, which is deformable, is preferably situated outside the base of the cathode, that is to say in the region which has a steep thermal gradient.

As in FIG. 1, the shield may be placed directly on thermal insulating brickwork 20 or on an intermediate supporting bed 9 and the shield may be separated from the cathodic blocks by the pulverulous supporting bed 5.

Figure 4:
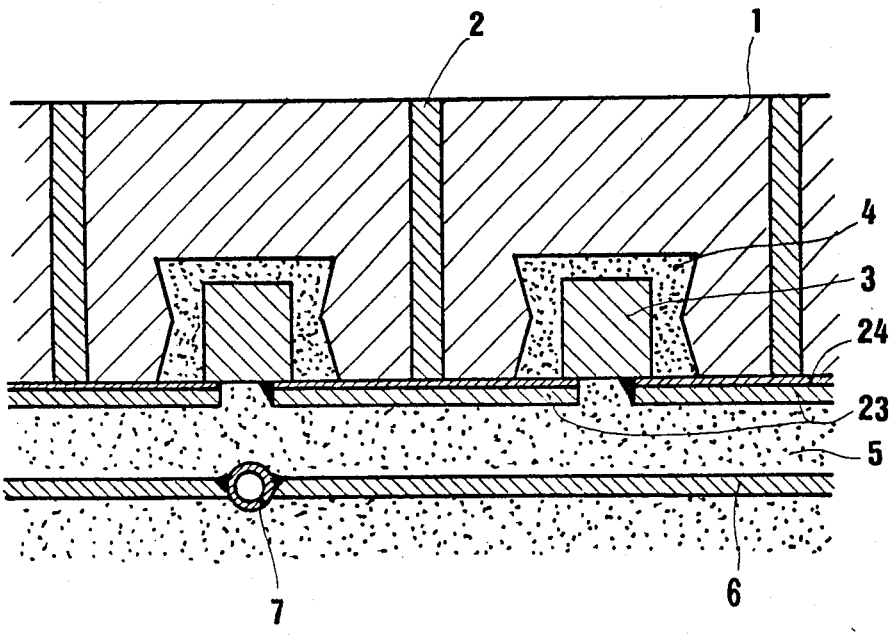
FIG. 4 is a fragmentary cross-sectional view showing a further embodiment of the shield device which is connected to the cathodic bars.

As shown in FIG. 4, another means for improving the efficiency and prolonging the life expectancy of the shield consists of using, simultaneously, the device disclosed in French patent application No. 83 08334 which consists of a bedplate of a thick steel sheet 23 which is connected to each cathodic bar 3 by a weld and is in electrical contact with at lest 50% of the surface of the base of carbonaceous blocks 1 either directly or by means of a connecting layer 24 which is elastic and current conducting and which is composed of, for example, graphite or carbon felt.

In addition to constituting a first barrier to the penetration of a sodium-containing and fluorine-containing impregnation products, this bedplate advantageously brings together throughout the supporting bed 5, two identical materials (steel) and thus prevents an electrochemical cell from forming should the supporting bed have, or develop, an ionic conductivity. The electrochemical corrosion of shield 6 is thus avoided and the chemical corrosion (by the impregnation products) is substantially checked.

The operation of the present invention allows the life expectancy of electrolysis cells to be substantially increased and thermal losses to be kept as low as possible throughout.

We claim:

1. In an electrolysis cell for production of aluminum by the Hall-Heroult process, wherein the cell is contained in a housing, the base of which is coated by a refractory and insulating material, and wherein the cathode of said cell comprises carbonaceous blocks above said base in which blocks cathodic bars are embedded, a steel metallic shield for preventing seepage of metal and constituents of the electrolysis bath into the insulating coating and housing of said cell, said shield comprising:

at least one continuous steel sheet extending substantially over the total area between the base of the cathode and the base of the housing, at least half the surface area of which sheet is at least 5 mm thick, and which has at least one deformable zone for absorbing thermal stresses caused by differences in temperature between the shield section situated below the central area of the cathode, and the section situated below the peripheral area of the cathode, said deformable zone comprising at least one closed profile, the wall of thickness of which is less than the thickness of the remainder of the shield.

2. In an electrolysis cell for production of aluminum by the Hall-Heroult process, wherein the cell is contained in a housing, the base of which is coated by a refractory and insulating material, and wherein the cathode of said cell comprises carbonaceous blocks above said base in which blocks cathodic bars are embedded, a steel metallic shield for preventing seepage of metal and constituents of the electrolysis bath into the insulating coating and housing of said cell, said shield comprising:

at least one continuous steel sheet extending substantially over the total area between the base of the cathode and the base of the housing, at least half the surface area of which sheet is at least 5 mm thick, and which has at least one deformable zone for absorbing thermal stresses caused by differences in temperature between the shield section situated below the central area of the cathode, and the section situated below the peripheral area of the cathode, said deformable zone comprising at least one open profile, the wall thickness of which is equal to or less than the thickness of the remainder of the shield.

3. In an electrolysis cell for production of aluminum by the Hall-Heroult process, wherein the cell is contained in a housing, the base of which is coated by a refractory and insulating material, and wherein the cathode of said cell comprises carbonaceous blocks above said base in which blocks cathodic bars are embedded, a steel metallic shield for preventing seepage of metal and constituents of the electrolysis bath into the insulating coating and housing of said cell, said shield comprising:

at least one continuous steel sheet extending substantially over the total area between the base of the cathode and the base of the housing, at least half the surface area of which sheet is at least 5 mm thick, and which has at least one deformable zone for absorbing thermal stresses caused by differences in temperature between the shield section situated below the central area of the cathode, and the section situated below the peripheral area of the cathode, said deformable zone comprising a sheet of steel of lesser thickness than the remainder of the shield, which sheet is located at the periphery of said shield and which extends into the zone which is situated directly outside the base of the cathodic blocks and is linked to the remainder by a continuous weld and has an elongation before break of greater than 2% when cold, at 20° C.

4. A shield according to claim 1, 2 or 3, comprising two separate sections, a thick section being at least 5 mm thick being provided with means for absorbing the expansion stresses, and a disconnected section comprising a series of sheets of lesser thickness which are superposed on each other, each said superposed sheet being less than 5 mm thick, and being located between the base of the cathode and the thick section therebelow.

5. A shield according to claim 1, 2 or 3, additionally comprising, a disconnected upper section which is formed by a steel bedplate which is connected to each cathodic bar by a weld and is in electrical contact with at least 50% of the surface of the lower base of the corresponding carbonaceous block.

6. The shield according to claim 1, 2 or 3, wherein said continuous steel sheet has a thickness of 8 to 12 mm.

7. In an electrolysis cell for production of aluminum by the Hall-Heroult process, wherein the cell is contained in a housing, the base of which is coated by a refractory and insulating material, and wherein the cathode of said cell comprises carbonaceous blocks above said base in which blocks cathodic bars are embedded, a steel metallic shield for preventing seepage of metal and constituents of the electrolysis bath into the insulating coating and housing of said cell, said shield comprising:

at least one continuous steel sheet extending substantially over the total area between the base of the cathode and the base of the housing, at least half the surface area of which sheet is at least 5 mm thick, and which has at least one deformable zone for absorbing thermal stresses caused by differences in temperature between the shield section situated below the central area of the cathode, and the section situated below the peripheral area of the cathode, wherein said shield comprises two separate sections, a thick section being at least 5 mm thick being provided with means for absorbing the expansion stresses, and a disconnected section comprising a series of sheets of lesser thickness which are superposed on each other, each said superposed sheet being less than 5 mm thick, and being located between the base of the cathode and the thick section therebelow.

8. In an electrolysis cell for production of aluminum by the Hall-Heroult process, wherein the cell is contained in a housing, the base of which is coated by a refractory and insulating material, and wherein the cathode of said cell comprises carbonaceous blocks above said base in which blocks cathodic bars are embedded, a steel metallic shield for preventing seepage of metal and constituents of the electrolysis bath into the insulating coating and housing of said cell, said shield comprising:

at least one continuous steel sheet extending substantially over the total area between the base of the cathode and the base of the housing, at least half the surface area of which sheet is at least 5 mm thick, and which has at least one deformable zone for absorbing thermal stresses caused by differences in temperature between the shield section situated below the central area of the cathode, and the section situated below the peripheral area of the cathode, wherein said shield additionally comprises a disconnected upper section which is formed by a steel bedplate which is connected to each cathodic bar by a weld and is in electrical contact with at least 50% of the surface of the lower base of the corresponding carbonaceous block.

* * * * *